US005549293A

United States Patent [19]

Seifert

[11] Patent Number: 5,549,293

[45] Date of Patent: Aug. 27, 1996

[54] BASKETBALL GAME WITH PLAYING BOARD

[76] Inventor: Mark A. Seifert, 1151 Sonora Apt. 114, Glendale, Calif. 91201

[21] Appl. No.: 417,620

[22] Filed: Apr. 6, 1995

Related U.S. Application Data

[63] Continuation-in-part of Ser. No. 199,524, Jun. 20, 1994, abandoned.

[51] Int. Cl.[6] ..... A63B 63/08

[52] U.S. Cl. ..... 273/1.5 R

[58] Field of Search ..... 273/1.5 R, 1.5 A, 273/85 R, 236, 242, 243

[56] References Cited

U.S. PATENT DOCUMENTS

| | | | |
|---|---|---|---|
| 1,099,563 | 6/1914 | Meyers | 273/243 |
| 1,594,807 | 8/1926 | Wurth | 273/85 R |
| 1,612,699 | 12/1926 | Cole | 273/85 R |
| 2,201,560 | 5/1940 | Nelson | 273/85 R |
| 2,421,220 | 5/1947 | Robinson | 273/1.5 R |
| 2,611,615 | 9/1952 | Watson et al. | 273/35 R |
| 2,893,734 | 7/1959 | Tarte | 273/1.5 R |
| 3,137,503 | 6/1964 | Ballard | 273/1.5 R |
| 3,703,291 | 9/1971 | Lutz | 273/85 R |
| 3,827,691 | 8/1974 | Benander | 273/85 R |
| 3,941,386 | 3/1976 | Nelson | 273/85 R |
| 5,120,053 | 6/1992 | Head et al. | 273/1.5 R |
| 5,123,653 | 6/1992 | Murphy et al. | 273/85 R X |

*Primary Examiner*—William E. Stoll

[57] ABSTRACT

The present invention is a basketball game having a basketball, a basketball court, a plurality of basketball goals. A plurality of teams each having a plurality of players plays the basketball game on the court and shoots the basketball in the direction of the basketball goals. Also included is a deck of cards that each have a front face containing a separate and distinct identifier unique to each card. The basketball court includes a playing board with varying sizes facilitating the playing of basketball games in a variety of areas corresponding to the playing board. The playing board has site identifiers located on the playing board which are associated with each of the unique identifiers of each of the cards. Each player draws a card and attempts to successfully shoot the basketball through one of the basketball goals while located on a matching site identifier. Succeeding players reiterate the procedure until the game is ended based by predetermined rules. Point scoring is associated with each shot.

7 Claims, 3 Drawing Sheets

BASKETBALL GAME WITH PLAYING BOARD

CROSS REFERENCE TO RELATED APPLICATIONS

This application is a continuation-in-part of application Ser. No. 08/199,524 filed Jun. 20, 1994, now abandoned which application is incorporated herein by reference.

BACKGROUND OF THE INVENTION

1. Field of the Invention

The present invention relates, in general, to sporting games, and in particular, to basketball games utilizing a specially adapted playing board.

2. Related Art.

Various types of games played with the conventional 52 card playing deck, such as poker, draw poker, 5 card stud poker, solitaire, pinochle, etc., are well known. Also, the use of non-conventional playing card decks with corresponding games is well known. Such decks have a different number of cards and/or suits from the conventional 52 card deck.

The conventional games associated with the conventional playing card deck are extremely popular and date back hundreds of years. However, most games associated with playing card decks are non-contact and non-action. For instance, most games played with the conventional playing card deck are performed sitting at a table for hours. Thus, although the conventional playing card deck is extremely popular and well known, games played with the conventional deck lack athletic action because they are played in a seated position for hours.

However, the game of basketball is athletic and involves action. Basketball is an extremely popular contact athletic sport played all over the world. Basketball is played on a court with an inflated ball by two opposing teams each having at least one player. The object of basketball is to put a ball through an annular member, referred to as a goal or basket, secured to a backboard. One annular member is located at one end of the basketball court, while the other annular member is located at the other end. Each of the annular members have a net which extends downward from the outer rim of the annular member. The basketball is typically thrown from different locations on the basketball court.

The team with the ball is the offensive team. The offensive team advances the ball to the basket on the court which is designated as their basket by passing the ball to a teammate or by dribbling or bouncing the ball along the floor with one-hand taps. The offensive team scores by throwing the ball so that it descends through the designated basket. The team scoring the most such throws, wins the game.

The team without the ball is the defensive team. The defensive team attempts to take the ball from the offensive team by intercepting passes, blocking shots, or even by literally stealing the ball from a player with the ball. After a basket is made, the ball is awarded to the team that was previously on defense. Because of the continuous action, contact with opposing players, competition for the ball, and frequent scoring, basketball is one of the most popular spectator as well as participant sports in the world. Nevertheless, since basketball is a very fast paced and a high contact game, it requires high endurance capabilities because offense and defense is constantly changing. Consequently, young children, physically handicapped individuals, as well as individuals desiring a slower paced game, cannot play the conventional full court basketball as described above.

Therefore, what is needed is an athletic game that does not require a fast pace but still involves skill and athletic action. What is also needed is a game that allows players to exhibit offensive basketball skills without defensive interference. What is further needed is an action based sporting game that combines offensive basketball skills with the conventional playing card deck.

Whatever the merits of the above mentioned systems and methods, they do not achieve the benefits of the present invention.

SUMMARY OF THE INVENTION

To overcome the limitations in the prior art described above, and to overcome other limitations that will become apparent upon reading and understanding the present specification, the present invention discloses a basketball game having a basketball, a basketball court, and a plurality of basketball goals. A plurality of teams each having a plurality of players plays the basketball game on the court and shoots the basketball in the direction of the basketball goals.

A deck of cards is also included. Each card in the deck has a front face containing a separate and distinct identifier unique to each card. The basketball court includes a playing board with varying sizes facilitating the playing of basketball games in a variety of areas corresponding to the playing board. The playing board has site identifiers located on the playing board which are associated with each of the unique identifiers of each of the cards. Each player draws a card and attempts to successfully shoot the basketball through one of the basketball goals while located on a matching site identifier. Succeeding players reiterate the procedure until the game is ended based by predetermined rules. Point scoring is associated with each of shot.

A feature of the present invention is to have a basketball game utilizing a playing board. Another feature of the present invention is to have a basketball game that combines offensive basketball skills with the conventional playing card deck. Yet another feature of the present invention is a basketball game having offensive action without defensive action.

An advantage of the present invention is that it can be played by small children and physically handicapped individuals. Another advantage is that the present invention requires skill and has athletic sporting action. Another advantage is that the present invention allows players to exhibit offensive basketball skills without defensive interference.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
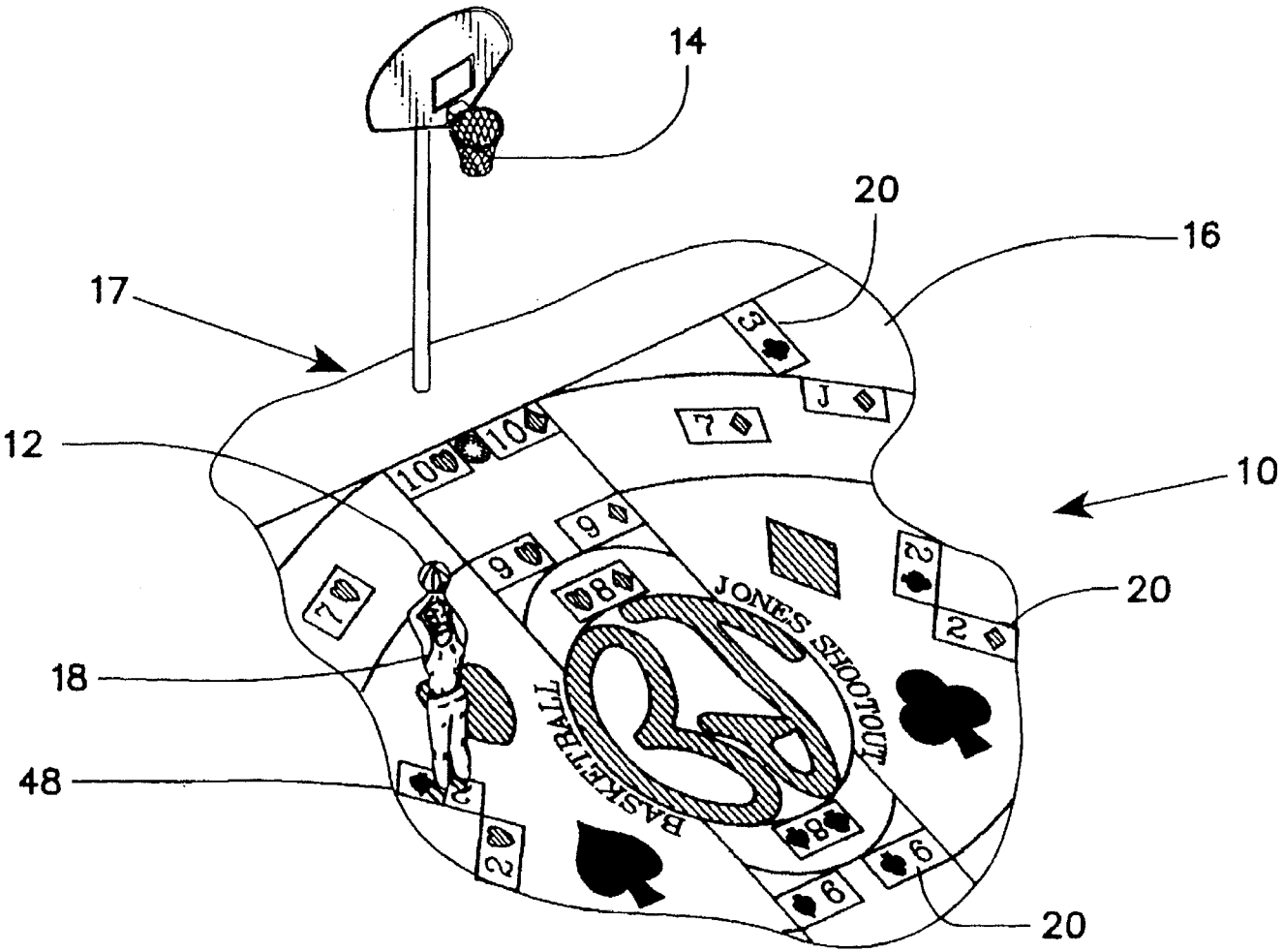
FIG. 1 illustrates the overall layout of the present invention.

FIG. 1 illustrates an exploded overall sectional view 10 of the present invention. The present invention includes a basketball 12, two basketball goals 14 (only one shown), a playing board 16 adaptable as a basketball court 17, and two or more teams with players 18. The playing board 14 contains site identifiers or positions 20 associated as unique indicia. The positions 20 are strategically organized about the playing board 14.

In the preferred embodiment, the basketball goal 14 is ten feet above the court 17 and a conventional National Basketball Association basketball 12 is used. However, in an alternative embodiment, the basketball goal 14 and basketball 12 can be adapted for indoor use as well as miniaturized for table top use.

Figure 2:
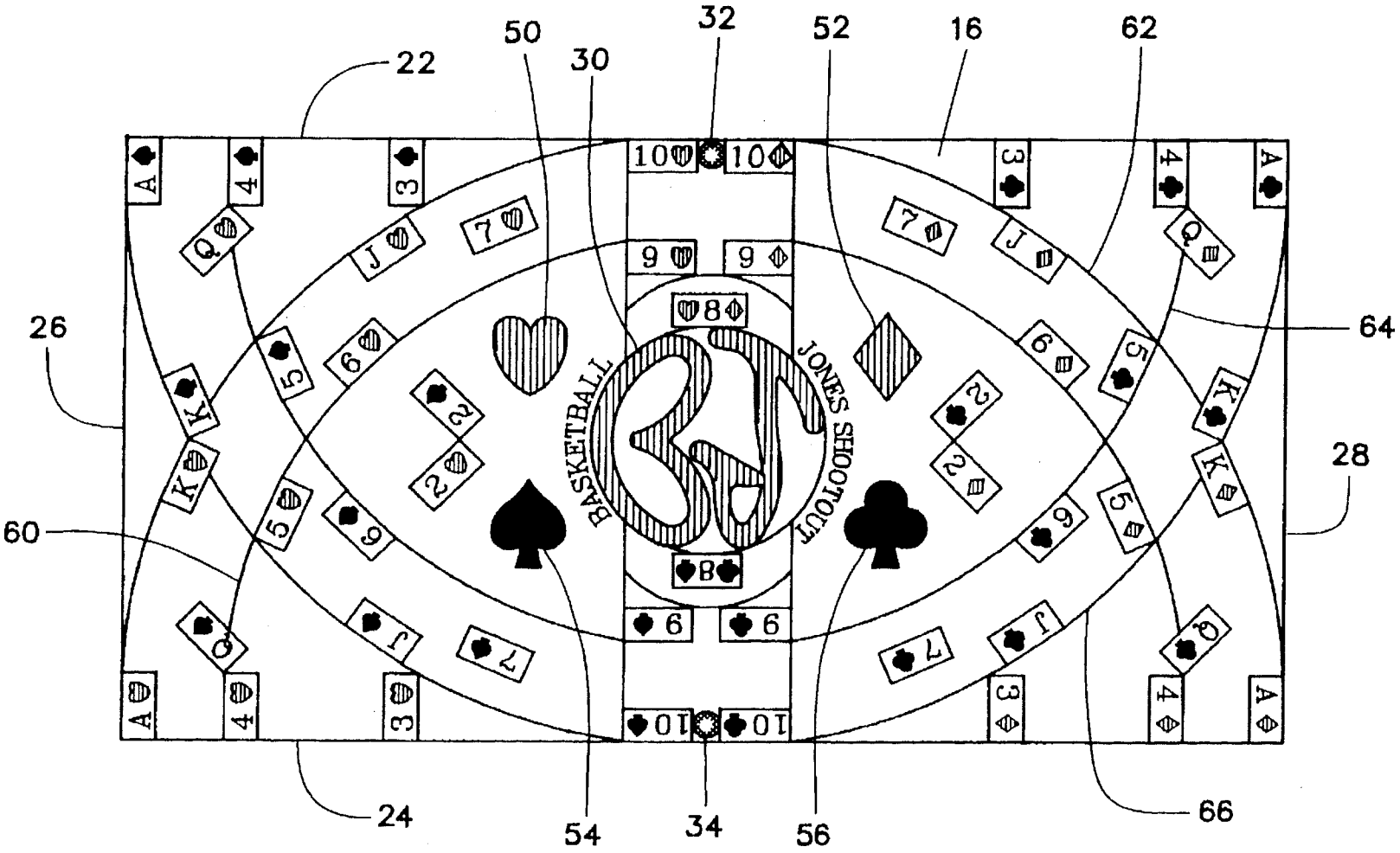
FIG. 2 illustrates the preferred playing board for use with the present invention.

FIG. 2 illustrates the playing board 16 utilized in the preferred embodiment of the present invention. The playing board 16 is preferably in the form of one integrated floor mat but can be separate floor mats or painted appropriate positions. The playing board 16 corresponds to the particular size of the basketball court 17 (shown in FIG. 1).

The playing board 16 has a first 22 and second 24 longside and a first 26 and second 28 wideside. The center of the playing board has a "BJ" 30 logo contained in a circle. Small netted 32 and 34 circles are located at the edge of each longside 22 and 24 respectively, and are centered about the longsides. The playing board 16 is positioned on the basketball court 17 so that each small netted circle 32 and 34 corresponds to a location directly below each of the basketball goals 14 (shown in FIG. 1). Thus, the basketball goals 14 are located on opposite longsides 22 and 24 of the playing board 16 and basketball court 17 and face each other.

The set of dimensions for the playing board 16 and basketball court 17 used in the present invention can vary. For example, in the preferred embodiment, a forty-four feet long, and twenty-two feet wide basketball court 17 and playing board 16 can be utilized. In addition, a playing board 16 suitable for home use, such as twenty feet long and ten feet wide playing board 16 can be used. Further, a playing board 16 suitable to be used on a table-top, such as five feet long and three feet wide playing board 16 can be used.

Figure 3:
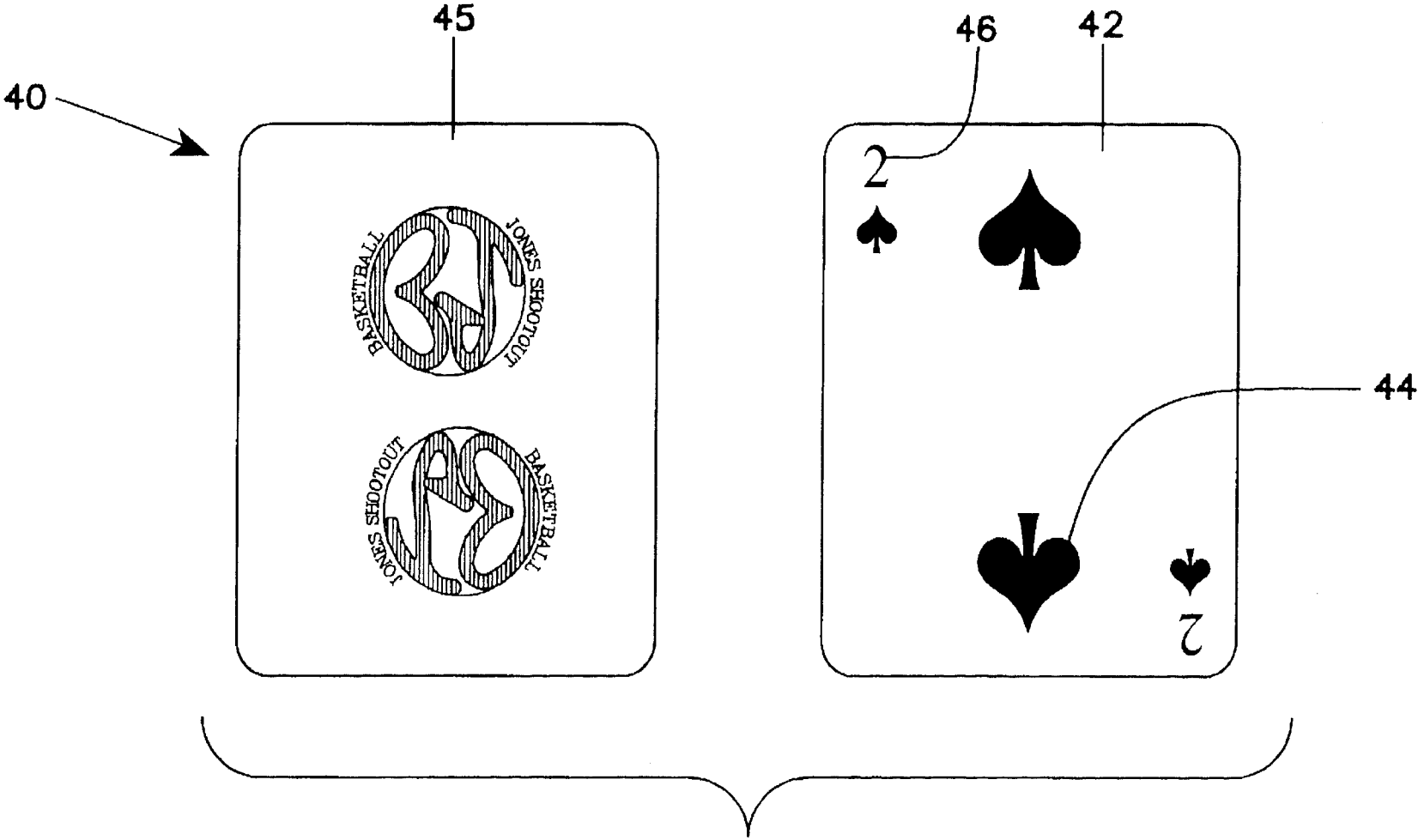
FIG. 3 illustrates the preferred card deck for use with the present invention.

FIG. 3 illustrates a conventional playing card deck 40 utilized in the present invention. The conventional playing card deck 40 utilized in the present invention contains a front side 42 with varying suit symbols 44 and colors and identical back sides 46. Each front side 42 preferably has a rank 46 represented by the numeric values 2–10 and by the alpha characters J, Q, K, and A, imprinted therein. The alpha characters J, Q, and K contain personage visual representations of a Knave or Jack for J, a Queen for Q, and a King for K.

Also, the cards 40 contain four suits, each being the Spade 44, Heart (not shown), Diamond (not shown), and the Club (not shown). Each suit 44 is represented by a pip symbol 44 (shape and color representing the suit). The pip color of the Spades and Clubs are black and the pip color of the Hearts and Diamonds are red. Standard size playing cards are used, such as the 3.5 inches long and 2.5 inches wide poker deck, as well as the 3.5 inches long and 2.25 inches wide standard bridge deck.

Referring back to FIGS. 1 and 2 along with FIG. 3, there are fifty two positions on the playing board 16 that each correspond to one of the fifty two playing cards 40. The suits 44 and ranks 46 of each playing cards is marked on each respective corresponding position 48 on the playing board 16. The fifty two positions on the playing board are arranged around the circle with the "BJ" logo. The fifty two positions are strategically distanced from the basketball goal 14 (shown in FIG. 1). The color of the suit on each respective position indicates which basketball goal is the target goal or the goal that a particular player 18 shoots at.

Specifically, a red colored heart 50 and diamond 52 are located between the "BJ" 30 logo and the first longside 22. These red colored shapes 50 and 52 indicate that the far basketball goal above the red small netted circle 34, is the target goal for all red suited positions. Likewise, a black colored spade 54 and club 56 are located between the second longside 24 and the "BJ" logo 30. These black colored shapes 54 and 56 indicate that the far basketball goal 14, represented by the black netted circle 32, is the target goal for all black suited positions. In addition, every position on the playing board 16 between the heart 50 and the spade 54 and the first wideside 26 has a spade or heart as a suit. Similarly, every position on the playing board 16 between the diamond 52 and the club 56 and the second wide 28 side has a diamond or club as a suit.

A 2 point semi-circle 60 with only red suits located thereon is located between the heart 50 and the diamond 52 and the first longside 22 and extends from the second longside 24 near the first wideside 26 to the second 24 longside near the second wideside 28. A 3 point semi-circle 62 only with red suits located thereon is located between the 2 point and semi-circle 60 and the first longside 22 and extends from the intersection of the first wideside 26 and the second longside 24 to the intersection of the second wideside 28 and the second longside 24.

Likewise, a 2 point semi-circle 64 and a 3 point semi-circle 60 only for black suits are located similarly to the 2 and 3 point semi-circles for the red suits such one set of semi-circles mirror the other set. Each 2 point semi-circle 60 and 64 is preferably twenty feet from each small netted circle 34 and 32 respectively. Each 3 point semi-circle 62 and 66 is preferably twenty two feet from each small netted semi-circle 34 and 32 respectfully.

Some, but not all, of the positions with the suit and rank corresponding to the cards of FIG. 2 are located on the 2 and 3 point semi-circles 60, 62, 64, and 66, respectfully. A team is awarded two points for shots taken and made from the 2 point semi-circle 60 and 62 into the respective target basket and three points for shots taken and made from the 3 point semi-circles 64 and 66 into the respective target basket. For example, the Ace, King, Jack, and Ten rank cards are located on respective 3 point semi-circles 64 and 66 while some lower ranking cards are located on the 2 point semi-circles 60 and 62.

In accordance with the present invention, the game is played by first having a player 18 from one team draw a card 43 from the card deck 40. The player 18 then shoots the basketball 12 from one of the fifty two positions 48 on the board 16 that matches the card drawn 43 from the deck 40. Since each of the fifty two positions located on the playing board 16 has a point value associated with a successful basket, the team is awarded or not awarded points accordingly. Next, the procedure is reiterated with succeeding players of each team until the game is ended, which is decided by predetermined rules.

Sample Game

Numerous games with different rules can be played with the present invention. For instance, the following is a description of one sample basketball game. Referring to FIGS. 1–3, a card 43 is drawn form the deck of playing 40 cards by one player at a time. There are at least two teams each comprised of at least two players. The player 18 from one team matches the suit and rank on the card drawn 43 with the suit and rank location 48 on the playing board 16. The player 18 then shoots the basketball 12 from that matched location 48 on the playing board 16 toward the designated basketball goal. A joker card can also be used as player's 18 "choice" shot. Players from opposite teams alternate.

All players drawing black suited cards shoot at the designated black goal. Likewise, all players drawing red suited cards shoot at the designated red goal. Players drawing a card with the rank of A, K, Q, J, or 10, are awarded three points for a shot successfully made into the designated basketball goal from the matching position on the playing board. Players drawing a card with the rank of 10, 9, 8, 7, 6, 5, 4, 3, or 2 are awarded two points for a shot successfully made into the designated basketball goal from the matching position on the playing board.

The card deck is drawn through two times. Cards are not mixed after first time drawn through. Instead, the team that started first starts now goes second and the team that went second starts. Also, each team can decide which player will draw their first card and take their first shot. As a result, since the cards are not mixed in the deck after the deck has been drawn through, the rotation of teams will give each team the opportunity to play all the cards at least once.

In addition, the last player can take a three point shot from a position on the playing board if needed for a win or tie. The other team will indicate the position of the three point shot. The team with the most points at the end of the second draw wins.

However, in the case where each team has the same amount of points, a special tiebreaker round is played. Each team draws a card to determined which team will go first. For example, the team drawing the highest ranking card according to conventional card rules, goes first. The team going first designates a player to shot for the team. The player can shoot toward the designated goal from any position on the playing board. If the player makes the goal, a designated player from the second team must shoot the basketball at the same goal from the same position. If this player from the second team does not make the same shot, his team receives a "miss" point. However, if the player from the second team makes the shot, a new designated player from the first team must also make the same shot or receive a "miss" point. If all the players from each team make that shot, then the first player to shoot must choose another location to shoot. This special round is continued until a team receives three "miss" points.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A basketball game having a basketball, a basketball court, and a plurality of basketball goals, comprising:

a plurality of distinct shooting sites located on a top surface face of said basketball court, signifying different positions on said basketball court, wherein each distinct shooting site is designated to one of said plurality of basketball goals and is for shooting said basketball in the direction of said basketball goals;

a deck of cards each card being separate and distinct from one another, wherein each distinct shooting site is uniquely associated with only one of said cards; and a plurality of point scoring boundaries located on said top surface of said basketball court, wherein each distinct shooting site is designated to one of said point scoring boundaries, and wherein each of said point scoring boundries is designated with a predetermined number of points if said basketball descends into said basketball goal when said basketball is shot from one of said distinct shooting sites.

2. The invention as set forth in claim 1, wherein said top surface is a removable playing board suitable to cover said basketball court.

3. The invention as set forth in claim 1, wherein said deck of cards is a deck of playing cards, each card being a combination either a black type or a red type, and one of fourteen different alpha-numeric types.

4. A method for playing a basketball game including a basketball, a plurality of cards, two basketball goals, and a basketball court with a top surface, comprising the steps of:

(a) a placing a playing board on said top surface of said basketball court, wherein said playing board has a plurality of distinct indicia positions, and wherein each indicia position is uniquely designated to only one of said cards, is appointed to one of said basketball goals, and is designated with a predetermined amount of points;

(b) drawing a card from said deck;

(c) shooting said basketball from a designated indicia position on said playing board designated by one of said cards drawn toward one of said basketball goals appointed to said designated indicia position;

(d) determining whether said basketball descends through said basketball goal after said shooting step;

(e) assigning said predetermined amount of points if said determining step indicates that said basketball descended through said basketball goal;

(f) repeating steps (a) through (d) by a predetermined succession order.

5. A basketball game having a basketball, a basketball court, and first and second basketball goals, comprising:

a plurality of distinct shooting sites located on a playing board situated on said basketball court, wherein each distinct shooting site is designated to one of said basketball goals, and wherein each distinct shooting site signifies a different position on said basketball court for shooting said basketball in the direction of said basketball goals;

a first set of cards and a second set of cards, wherein each card of each set is uniquely associated with only one of said distinct shooting sites; and first and second point scoring boundaries located on said playing board, wherein a first portion of said distinct shooting sites is appointed to said first point scoring boundaries and a second portion of said distinct shooting sites is appointed to said second point scoring boundaries, and wherein each of said point scoring boundaries is appointed with a predetermined number of points if said basketball descends into said basketball goal when said basketball is shot from one of said plurality of distinct shooting sites;

wherein said first set of cards is associated with said first basketball goal and said second set of cards is associated with said second basketball goal.

6. The invention as set forth in claim 5, wherein said first and said second set of cards each comprise a subset first group and a subset second group, wherein each card in said subset first group is associated with one of said distinct shooting sites of said first portion appointed to said first point scoring boundaries and wherein each card in said subset second group is associated with one of said distinct shooting sites of said second portion appointed to said second point scoring boundaries.

7. The invention as set forth in claim 6, wherein said plurality of distinct shooting sites comprises fifty-two distinct shooting sites, wherein said first portion comprises sixteen distinct shooting sites, and wherein said second portion comprises thirty-six distinct shooting sites.

* * * * *